US007779760B2

(12) United States Patent
Konig

(10) Patent No.: US 7,779,760 B2
(45) Date of Patent: Aug. 24, 2010

(54) SHAPED CHARGE ASSEMBLY AND METHOD OF DAMAGING A TARGET

(75) Inventor: Pieter Johann Konig, Somerset West (ZA)

(73) Assignee: Armaments Corporation of South Africa Limited (ZA)

( * ) Notice: Subject to any disclaimer, the term of this patent is extended or adjusted under 35 U.S.C. 154(b) by 87 days.

(21) Appl. No.: 11/884,918

(22) PCT Filed: Feb. 23, 2006

(86) PCT No.: PCT/IB2006/050582

§ 371 (c)(1),
(2), (4) Date: Feb. 19, 2008

(87) PCT Pub. No.: WO2006/090338

PCT Pub. Date: Aug. 31, 2006

(65) Prior Publication Data

US 2008/0134925 A1 Jun. 12, 2008

(30) Foreign Application Priority Data

Feb. 23, 2005 (ZA) ..... 2005/01596

(51) Int. Cl.
*F42B 10/00* (2006.01)

(52) U.S. Cl. ..... 102/476; 102/306

(58) Field of Classification Search ..... 102/476, 102/306, 308, 310; 89/1.15
See application file for complete search history.

(56) References Cited

U.S. PATENT DOCUMENTS 2,766,690 A 10/1956 LeBourg
2,974,589 A 3/1961 Bryan
3,016,014 A 1/1962 LeBoug
3,215,074 A * 11/1965 Robinson, Jr. et al. ..... 175/4.5
3,388,663 A * 6/1968 Wyman, Sr. et al. ..... 102/476

(Continued)

FOREIGN PATENT DOCUMENTS

CN 2282064 Y 5/1998

(Continued)

OTHER PUBLICATIONS

"International Search Report, PCT Application No. WO2006090338", 3 pgs.

(Continued)

*Primary Examiner*—Michelle Clement
(74) *Attorney, Agent, or Firm*—Schwegman, Lundberg & Woessner, P.A.

(57) ABSTRACT

A shaped charge assembly (10) comprises a housing (20), first shaped charge (24), a wave shaping relay charge (44) and a second shaped charge (30) located in the housing. The assembly (10) is configured such that a first active element formed by initiation of the first shaped charge (24) causes detonation of the wave shaping relay charge (44), which in turn causes initiation of the second shaped charge (30) to form a second active element. The first active element moves beyond a second end (25) of the housing to cause damage of a first kind to an external target and the second active element also moves beyond the second end to cause damage of a second kind to the target.

19 Claims, 2 Drawing Sheets

U.S. PATENT DOCUMENTS

Figure 1:
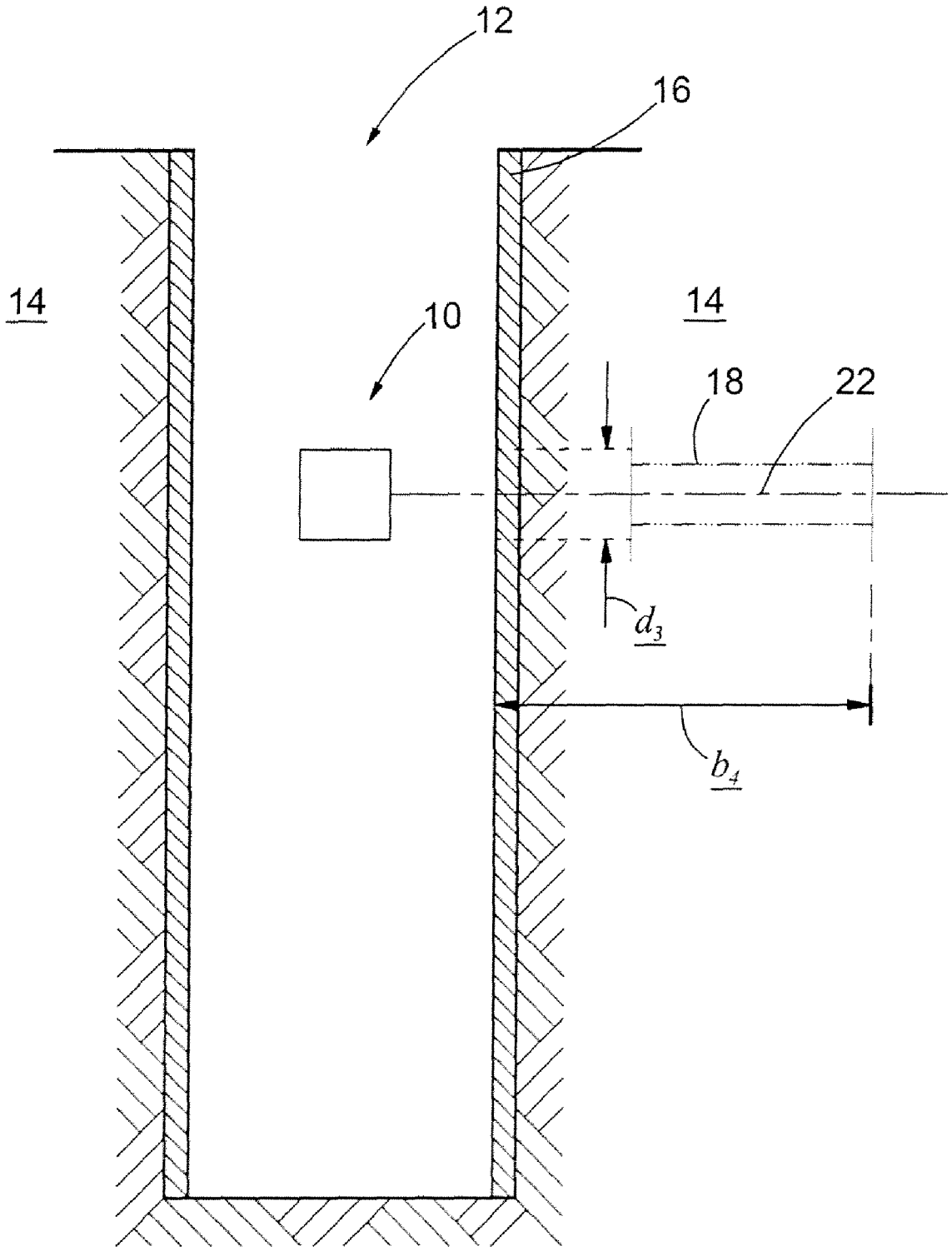

| | | | | |
|---|---|---|---|---|
| 3,750,582 | A * | 8/1973 | Kintish et al. | 102/476 |
| 4,063,512 | A * | 12/1977 | Davis | 102/476 |
| 5,394,804 | A * | 3/1995 | Cauchetier | 102/476 |
| 5,633,475 | A * | 5/1997 | Chawla | 102/306 |
| 5,744,746 | A * | 4/1998 | Tripptrap et al. | 102/476 |
| 6,012,392 | A * | 1/2000 | Norman et al. | 102/307 |
| 6,186,070 | B1 * | 2/2001 | Fong et al. | 102/476 |
| 2005/0188878 | A1 * | 9/2005 | Baker et al. | 102/306 |

FOREIGN PATENT DOCUMENTS

| | | |
|---|---|---|
| CN | 2531106 Y | 1/2003 |
| FR | 2410243 | 6/1979 |
| FR | 2813665 | 3/2002 |
| GB | 2039008 | 7/1980 |

OTHER PUBLICATIONS

"Chinese Application Serial No. 2006800057978, First Official Action mailed Sep. 12, 2008", (w/ English Translation), 9 pgs.

* cited by examiner

SHAPED CHARGE ASSEMBLY AND METHOD OF DAMAGING A TARGET

RELATED APPLICATIONS

This application is a nationalization under 35 U.S.C. §371 of PCT/IB2006/050582, filed Feb. 23, 2006 and published as WO 2006/090338 A1 on Aug. 31, 2006, which claimed priority under 35 U.S.C. §119 to South Africa Application No. 2005/01596, filed Feb. 23, 2005; which applications and publications are incorporated herein by reference and made a part hereof.

INTRODUCTION AND BACKGROUND

This invention relates to a shaped charge assembly for use in oil well perforation, military and other applications.

The term "shaped charge" is used in this specification to denote a charge that upon initiation produces a directed, high velocity active element. The active element may be a high velocity stretching jet followed by a low velocity slug or an explosively forged projectile.

In many applications there is a need to damage a target in more than one way. For example, in oil well perforation, there is firstly a need for deep penetrating transverse channels into surrounding hydrocarbon bearing rock and secondly for the channels to have large transverse cross sections. At present, these two requirements dictate two separate shaped charges with different configurations. Two separate shaped charges may take up too much space for some applications.

OBJECT OF THE INVENTION

Accordingly, it is an object of the present invention to provide an alternative shaped charge assembly and method of damaging a target with which the applicant believes the aforementioned disadvantages may at least be alleviated.

SUMMARY OF THE INVENTION

According to the invention there is provided a shaped charge assembly comprising:

- a first shaped charge;
- a wave shaping relay charge; and
- a second shaped charge;
- the assembly being such that a first active element formed by initiation of the first shaped charge causes detonation of the wave shaping relay charge, which in turn causes initiation of the second shaped charge.

The first and second shaped charges may be located in a housing and in use, the first active element moves beyond the housing after detonation of the wave shaping relay charge, to damage the target.

The first and second shaped charges are preferably arranged concentrically with a main axis of the housing. The housing may comprise a first end and a second end and the main axis may extend between the first end and the second end.

The assembly may comprise an initiator for the assembly located towards the first end, the wave shaping relay charge may be located towards the second end, and said first active element and a second active element formed by initiation of the second shaped charge may exit the housing at the second end, to damage the target.

The first shaped charge may be provided towards the first end and the second shaped charge may be provided between the first shaped charge and the second end of the housing.

The first shaped charge may comprise a first body of explosive and a first liner having a first caliber. The second shaped charge may comprise a second body of explosive and a second liner having a second caliber.

The first caliber may be smaller than the second caliber. In other embodiments wherein there is sufficient space or clearance between the first and second shaped charges, the first and second calibers may be substantially equal, or the first caliber may be larger than the second caliber.

The first and second liners may each comprise a hollow cone having an apex region and a respective opposed base and the respective bases may be facing towards the second end. The first liner may be made of a suitable metal such as copper or iron and the second liner may be made of powder metallurgy. The cones may have straight walls, or the walls may be curved, so that the liners are trumpet or tulip shaped.

The second liner may be truncated to define a hole in the apex region thereof. The first shaped charge may be located in close proximity to or be piggybacked on the second shaped charge and mounted in line with the hole.

The wave shaping relay charge is generally conical in configuration and may form part of a wave shaping relay charge arrangement comprising first and second hollow metal cones confining a layer of the wave shaping relay charge between them.

The layer of wave shaping relay charge may terminate in a circumferential ring-shaped booster charge. The booster charge may be in initiating relationship, preferably direct contact with said second body of explosive of the second shaped charge.

The conically shaped wave shaping relay charge arrangement may comprise an apex region and an opposed base. The arrangement is preferably mounted concentrically with the first and second shaped charges, with the base thereof facing towards the first end of the housing.

Also included within the scope of the present invention is a method of damaging a target comprising the steps of:

- initiating a first shaped charge to form a first active element;
- utilizing the first shaped charge element to initiate a second shaped charge;
- causing the first active element to cause damage of a first kind to a target; and
- causing the second active element to cause damage of a second kind to the target.

The shape and/or configuration and/or materials of the first shaped charge may be selected to cause the first kind of damage and the shape and/or configuration and/or materials of the second shaped charge may be selected to cause the second kind of damage.

The first kind of damage may differ from the second kind of damage. The first and second shaped charges may be located in a single housing, said first active element may be a projectile that moves beyond the housing after initiation of the second shaped charge to damage the target, and the second active element may be a stretching jet that also moves beyond the housing, also to damage the target.

BRIEF DESCRIPTION OF THE ACCOMPANYING DIAGRAMS

Figure 2:
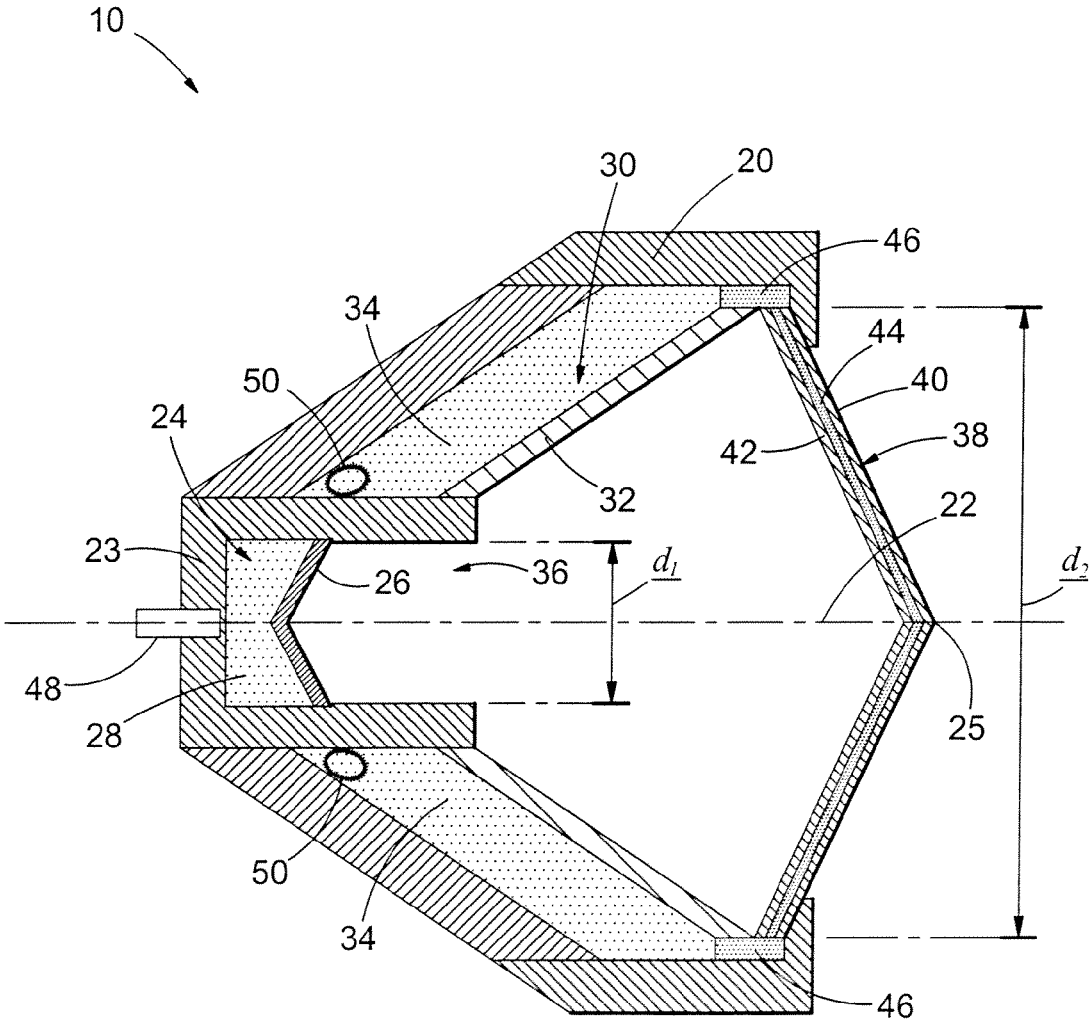

The invention will now further be described, by way of example only, with reference to the accompanying diagrams wherein FIG. 1: is a diagrammatic representation of an oil well and a perforator therefor comprising a shaped charge assembly according to the invention; and FIG. 2: is a diagrammatic axial section through a shaped charge assembly according to the invention.

DESCRIPTION OF A PREFERRED EMBODIMENT OF THE INVENTION

A shaped charge assembly according to the invention is generally designated by the reference numeral 10 in the figures.

Although the assembly may be used in a variety of applications, an oil well perforating application is illustrated by way of example in FIG. 1. An oil well 12 is drilled in known manner into hydrocarbon bearing rock 14. The well is lined with a casing 16 also in well known manner. In practice it is required to perforate the casing 16 and rock body in order to create channels or branches 18 extending transversely to the well and through which oil and gas can flow from the rock body 14 into the well 12. The assembly 10 according to the invention for performing the perforation will be described in more detail with reference to FIG. 2. In this kind of application there is generally a severe restraint on the total length of the assembly 10.

The assembly 10 comprises a metal housing 20 having a main longitudinal axis 22 extending between a first end 23 of the housing and a second end 25 of the housing. The housing is generally circular in transverse cross section and the assembly comprises a first generally circular shaped charge 24 comprising a first metal liner 26 of copper or iron and an associated first body of explosive 28. A second generally circular shaped charge 30 is located concentrically with the first charge 24 on axis 22. The second shaped charge 30 comprises a second liner 32 of powder metallurgy and an associated second body of explosive 34. The first and second liners are in the form of hollow cones each comprising an apex region and a respective opposed base. In the embodiment shown, the second liner 32 has a second calibre $d_2$ and is in the form of a truncated cone defining a hole 36 in the apex region of the cone. The first liner 26 is of a first and sub-calibre in that the first calibre $d_1$ of the first liner is smaller than the aforementioned second calibre. The first shaped charge is piggybacked on the second shaped charge and the first liner 26 is mounted in line with the hole 36. In other embodiments where there is sufficient space between the first and second shaped charges, the first and second calibres may be equal, or the first calibre may be larger than the second calibre. The cones may have straight walls as shown, alternatively the walls may be curved, so that the liners are tulip or trumpet shaped.

The first charge 24 is provided towards the first end 23 and the second charge 30 is provided between the first charge and the second end 25. The respective bases of the liners face towards the second end 25.

At the second end 25 there is provided a wave shaping relay charge arrangement 38 comprising first and second inverted hollow metal cones 40 and 42 which are also mounted concentrically with the axis 22. The cones 40 and 42 confine a wave shaping relay charge in the form of an explosive layer 44 between them. The layer 44 comprises a fine-grained explosive substance such as HNS. The layer 44 is preferably thin and the explosive 44 is preferably highly homogeneous. The layer 44 terminates in a circumferential ring-shaped booster charge 46. The booster charge is in initiating relationship, preferably direct contact with second body of explosive 34 of the second shaped charge 30.

An initiator 48 for the charge assembly 10 is provided towards the first end 23. The selection and arrangement of explosive material in annular region 50 of the body of explosive 34 is such that the shock of detonation of the body 28 of the first shaped charge 24 does not initiate detonation of the body of explosive 34 of the second shaped charge 30.

In use, the initiator 48 initiates the body of explosive 28 of the first shaped charge 24. The shape of the first liner 26 is such that a first active element in the form of an explosively forged projectile is formed upon detonation, which has a velocity of about 3000 meters per second and with only a slight difference in velocity for its respective regions along its path of travel towards second end 25.

A leading tip of the projectile impacts the wave shaping relay charge arrangement 38 with sufficient power to initiate detonation in the layer 44. Due to the aforementioned characteristics of the arrangement 38, the detonation propagates rapidly and radially outwardly between the metal cones 40 and 42 and in turn initiates detonation of the ring-shaped booster charge 46. The booster charge in turn initiates detonation circumferentially of second body of explosive 34 of the second shaped charge element 30.

The aforementioned projectile of the first shaped charge has, due to the shape and configuration of the first shaped charge, enough energy after perforation of arrangement 38, to move beyond the second end 25 of the housing and to punch a hole with relatively large cross sectional area into the casing 16 of the well, as well as a first part of channel 18 (shown in FIG. 1) with a relatively large cross sectional area $d_3$ into rock body 14. Said hole in the casing 16 and rock body 14 caused by the projectile from the first charge 24 is of benefit for increased penetration of the rock body 14 by a second active element in the form of a stretching jet formed by the second charge 30.

The collapse of second liner 32 results in the second active element in the form of a powder jet that occurs in time after the aforementioned projectile of the first shaped charge has penetrated into the target 16, 14 as aforesaid. The shape and configuration of the second shaped charge 30 is such that the resulting second active element will cause a deep penetration $b_4$ into the rock body 14.

It will hence be appreciated that the shape, configuration and materials in the second shaped charge 30 may be selected independently and differently from that of the first shaped charge 24, so that the resulting stretching powder jet would cause damage to a target which damage is generally different from the damage that would be caused by the projectile resulting from the first shaped charge. The arrangement 10 according to the invention also causes an inherent time delay between initiation of the first and second shaped charges respectively. This time delay may be designed such that the active element of the first charge is already out of the way by the time the second active element starts to form, thereby reducing the possibility of early interference between the two active elements.

The target may be an object different from the casing 16 and the rock body 14 as hereinbefore described. It may be a military or other target and therefore the assembly according to the invention may find application in military and other applications as well.

In another application of the invention, the shaped charge assembly is required to breach a wall of a target with enhanced damage beyond the wall. For such an application, the assembly 10 is configured so that the first shaped charge 24 produces a first active element that is capable of perforating the wall. The liner 32 of the second shaped charge 30 comprises suitable material capable of producing a second active element in which there is a sustained chemical reaction that would cause enhanced damage beyond the wall. In this configuration, a suitable spacing or clearance may be provided between the first and second shaped charges and the caliber or diameter of the first shaped charge may be larger than the diameter of the second shaped charge.

What is claimed is:

1. A shaped charge assembly comprising:

a first shaped charge and a second shaped charge mounted coaxially towards a first end of the assembly;

a relay charge mounted coaxially with the first and second shaped charges towards a second end of the assembly; and the assembly being such that a first active element formed by initiation of the first shaped charge moves axially in a direction towards the second end and causes detonation of the relay charge, which in turn causes initiation of the second shaped charge, the first active element moving axially beyond the second end to cause damage of a first kind to a target and a second active element formed by initiation of the second charge moving axially beyond the second end to cause damage of a second kind to the target.

2. The assembly as claimed in claim 1 comprising a housing wherein the first and second shaped charges and the relay charge are located.

3. The assembly as claimed in claim 1 comprising an initiator for the assembly located towards the first end of the assembly.

4. The assembly as claimed in claim 1 wherein the second shaped charge is provided between the first shaped charge and the second end of the assembly.

5. The assembly as claimed in claim 1 wherein the first shaped charge comprises a first body of explosive and a first liner having a first caliber and wherein the second shaped charge comprises a second body of explosive and a second liner having a second caliber.

6. The assembly as claimed in claim 5 wherein the first caliber is smaller than the second caliber.

7. The assembly as claimed in claim 5 wherein each of the first and second liners comprises a hollow cone having a respective apex region and a respective opposed base, and wherein the respective bases face towards the second end.

8. The assembly as claimed in claim 7 wherein the first liner is made of a metal and the second liner is made utilizing powder metallurgy.

9. The assembly as claimed in claim 7 wherein the cone of the second liner is truncated and defines a hole in the apex region thereof.

10. The assembly as claimed in claim 9 wherein the first shaped charge is mounted in line with the hole.

11. The assembly as claimed in claim 1 wherein the relay charge is in the form of a generally conical layer and forms part of a conical wave shaping relay charge arrangement comprising first and second hollow metal cones confining the layer between them.

12. The assembly as claimed in claim 11 wherein the layer of relay charge terminates in a circumferential ring-shaped booster charge.

13. The assembly as claimed in claim 12 wherein the booster charge is in direct contact with a body of explosive of the second shaped charge.

14. The assembly as claimed in claim 11 wherein the conical wave shaping relay charge arrangement comprises an apex region and an opposed base, and wherein the base thereof faces towards the first end of the assembly.

15. A method of damaging a target comprising:

initiating a first shaped charge mounted towards a first end of an assembly to form a first active element moving axially in line with a main axis in a direction towards a target;

utilizing the moving first active element to initiate a relay charge mounted towards a second end of the assembly;

utilizing the relay charge to initiate a second shaped charge mounted towards the first end of the assembly to form a second active element also moving axially in line with the main axis in the direction towards the target;

causing the first active element to cause damage of a first kind to a the target; and causing the second active element to cause damage of a second kind to the target.

16. The method as claimed in claim 15 wherein the first kind of damage is different from the second kind of damage.

17. The assembly as claimed in 5 wherein the first caliber is equal to the second caliber.

18. The assembly as claimed in claim 5 wherein the first caliber is larger than the second caliber.

19. The method as claimed in claim 16 wherein the first element causes a first hole having a first cross sectional area and extending a first distance into the target and wherein the second element causes a second hole substantially coaxially with the first hole having a second cross sectional area and extending a second distance into the target, wherein the first area is larger than the second area and the second distance is larger than the first distance.

* * * * *

UNITED STATES PATENT AND TRADEMARK OFFICE

CERTIFICATE OF CORRECTION

PATENT NO. : 7,779,760 B2
APPLICATION NO. : 11/884918
DATED : August 24, 2010
INVENTOR(S) : Pieter J. Konig It is certified that error appears in the above-identified patent and that said Letters Patent is hereby corrected as shown below:

In column 5, line 31, in Claim 5, delete "I" and insert -- 1 --, therefor.

In column 6, line 30, in Claim 15, delete "to a" and insert -- to --, therefor.

In column 6, line 35, in Claim 17, delete "5" and insert -- claim 5 --, therefor.

Signed and Sealed this

Thirtieth Day of November, 2010

David J. Kappos

David J. Kappos
*Director of the United States Patent and Trademark Office*